United States Patent [19]

Hlinsky et al.

[11] Patent Number: 4,592,601

[45] Date of Patent: Jun. 3, 1986

[54] EXPANDABLE MODULAR STORAGE SYSTEM

[75] Inventors: Emil J. Hlinsky, Oak Brook; Keith Hellon, Libertyville, both of Ill.

[73] Assignee: MacLean-Fogg Company, Mundelein, Ill.

[21] Appl. No.: 637,571

[22] Filed: Aug. 3, 1984

[51] Int. Cl.[4] ..... F16B 12/00

[52] U.S. Cl. ..... 312/111; 206/504; 211/194; 312/108; 312/257 A

[58] Field of Search ..... 211/194, 186, 26, 41, 211/126; 220/23.4; 206/504, 509; 312/257 A, 111, 184, 108, 10; 446/69, 108, 124, 127, 114, 115

[56] References Cited

U.S. PATENT DOCUMENTS

| | | | |
|---|---|---|---|
| 2,046,095 | 6/1936 | Shaw | 211/194 X |
| 4,199,070 | 4/1980 | Magnussen, Jr. | 211/194 |
| 4,239,137 | 12/1980 | Arcouette | 211/194 |
| 4,444,320 | 4/1984 | Chap | 211/194 |
| 4,531,640 | 7/1985 | Shah | 211/41 |

*Primary Examiner*—James T. McCall
*Attorney, Agent, or Firm*—Mason, Kolehmainen, Rathburn & Wyss

[57] ABSTRACT

An expandable modular storage system for holding slides and cassettes comprises storage compartments formed by a first wall element of C-shaped transverse cross-section having a pair of parallel facing walls integrally joined by a web or side wall normal thereto. The outer edge portions of the C-shaped elements are slidably interconnected with additional C-shaped elements along the opposite edges of the side wall to provide additional storage compartments as needed and a last compartment in a row is closed with a generally flat wall element having opposite edges slidably interconnected with the free outer edges of the walls of the last C-shaped wall element in a row. The storage system may include any number of rows of modular compartments and the rows are stacked vertically and interconnected with joining elements. Sliding drawers are provided when needed for the compartments and the drawers are dimensioned for containing slides and/or cassettes available for ready access and are compactly stored away in an orderly fashion when not in use. Any number of storage compartments may be provided in a stacked array of rows and columns which is expandable in vertical and horizontal directions as additional storage compartments are needed. The array may comprise a pattern that is widely variable to match the available spaces adjacent a wall or other surface.

32 Claims, 9 Drawing Figures

FIG. 1
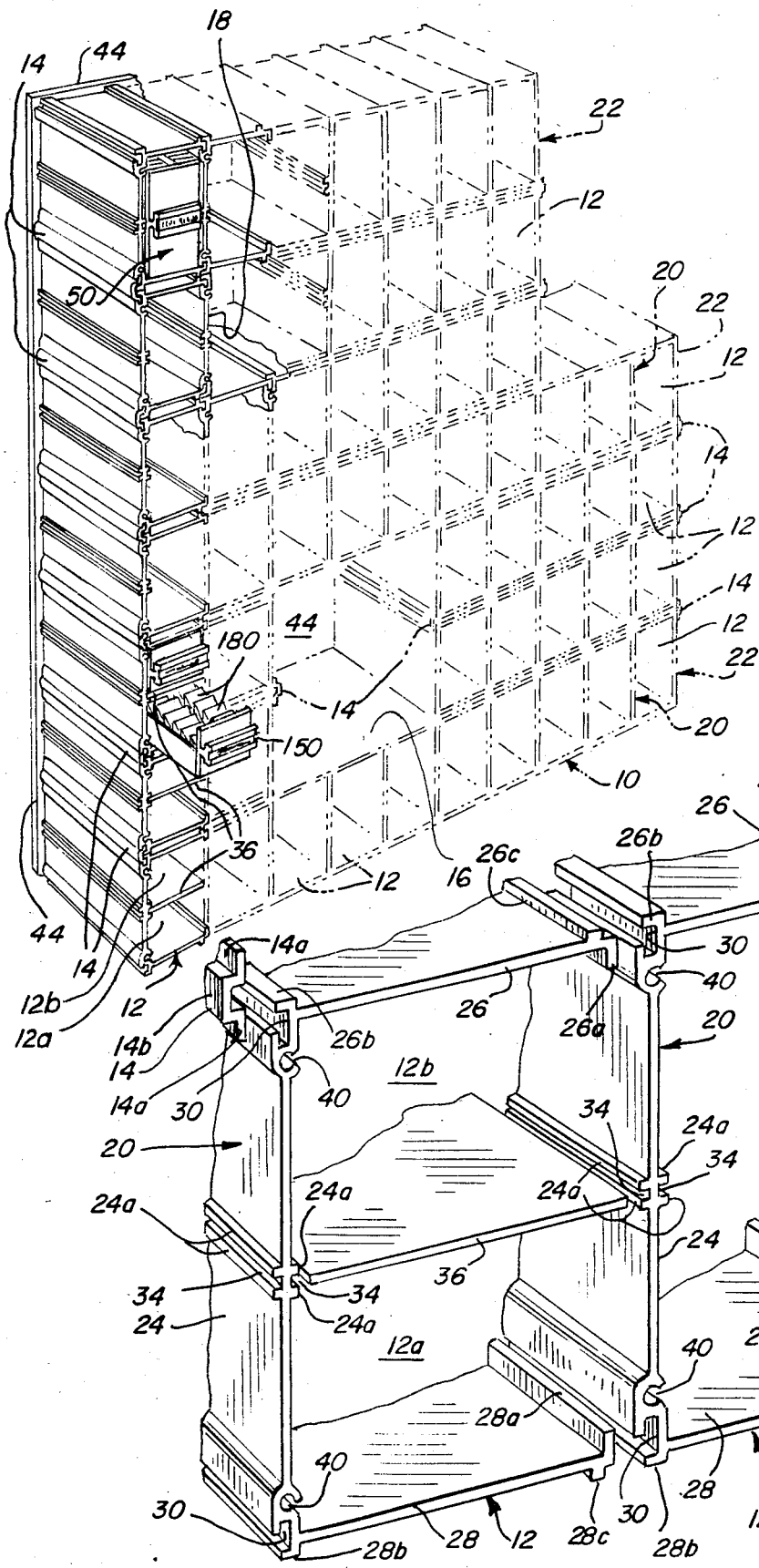
FIG. 1a
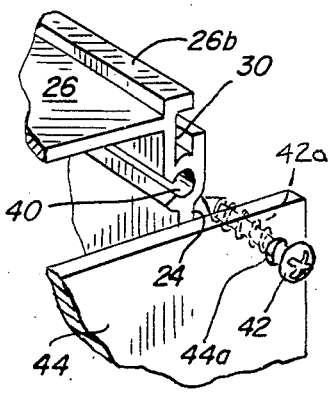
FIG. 2a
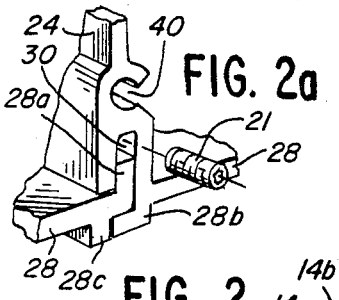
FIG. 2

FIG. 3
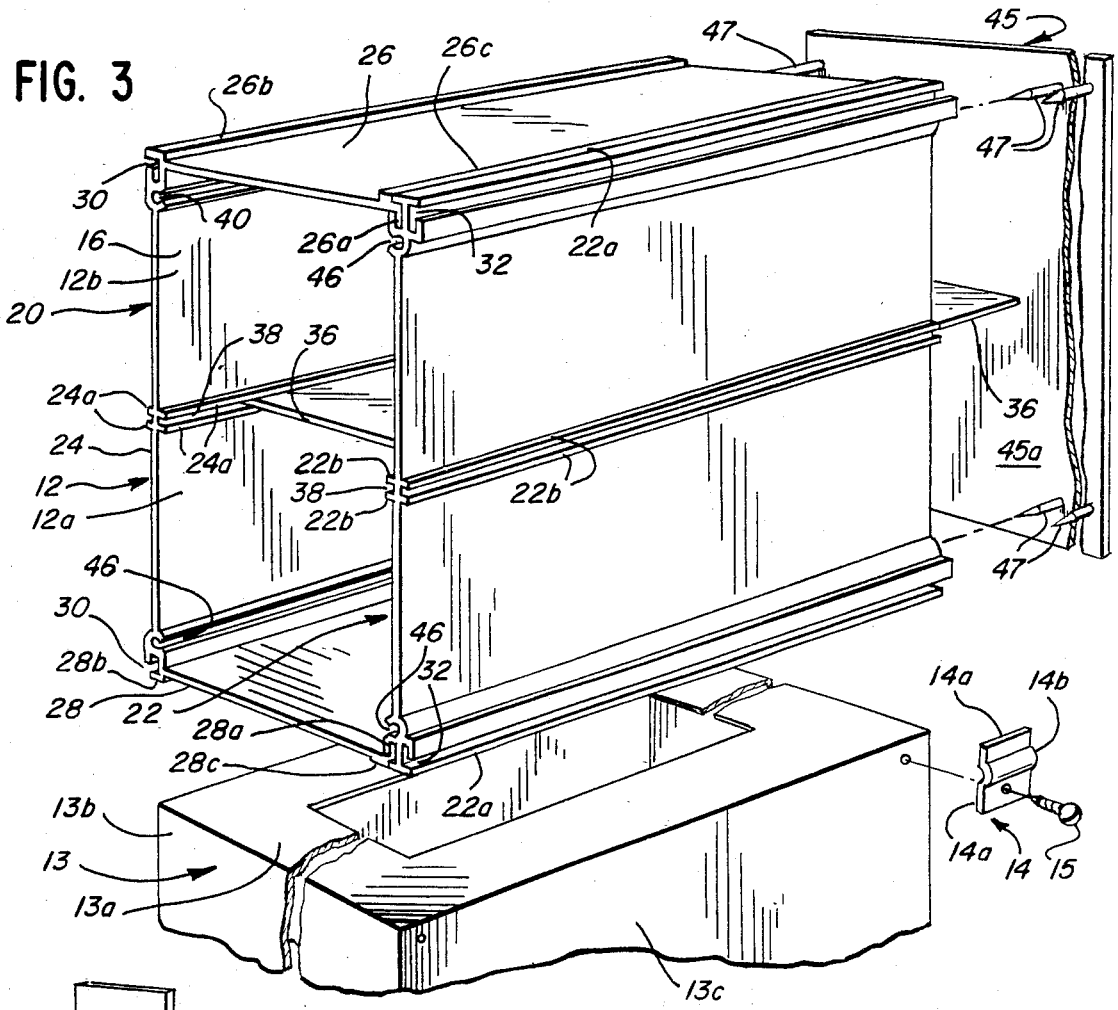
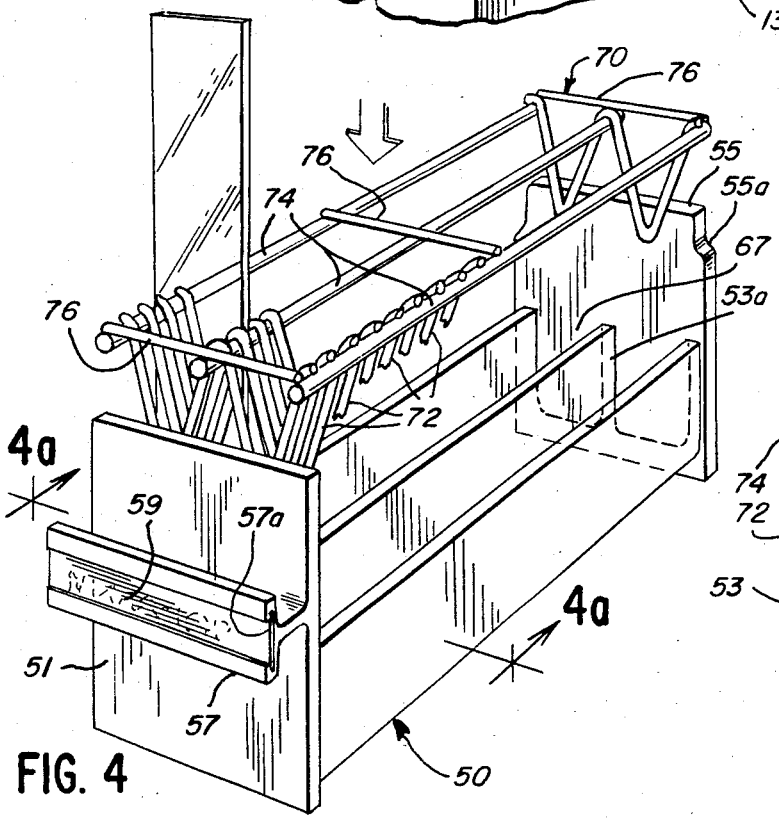
FIG. 4
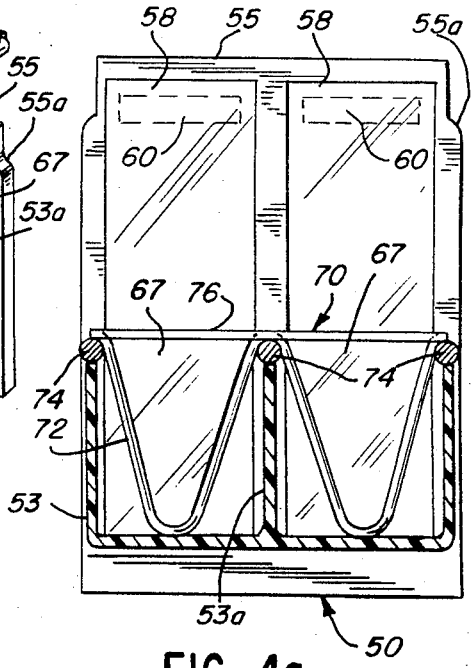
FIG. 4a

FIG. 5
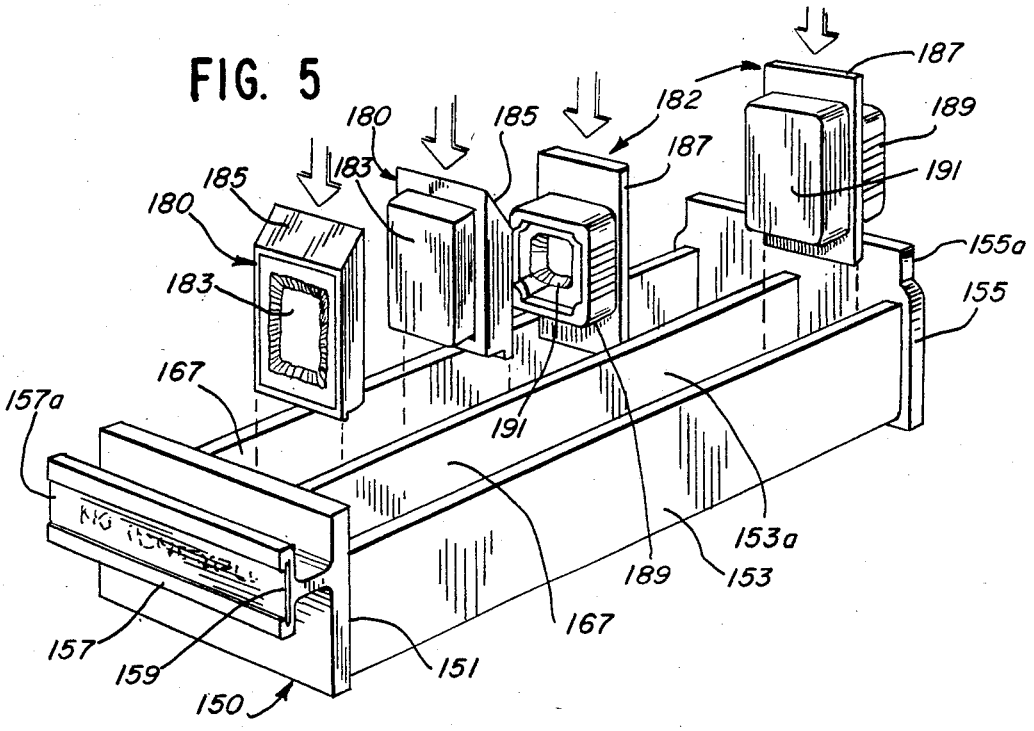
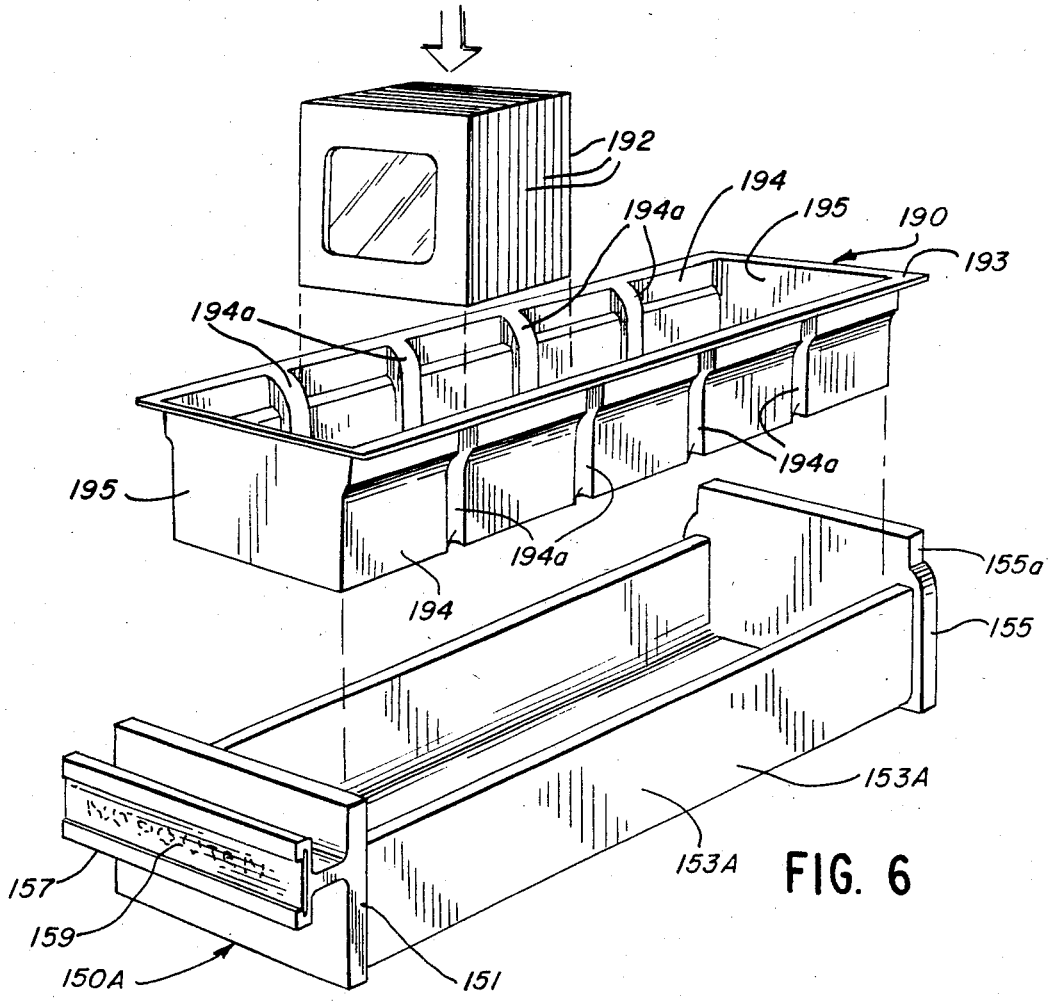
FIG. 6

EXPANDABLE MODULAR STORAGE SYSTEM

BACKGROUND OF THE INVENTION

1. Field of the Invention

The present invention relates generally to an expandable modular storage system and more particularly to an expandable modular storage system including a plurality of modular storage compartments which may be increased or decreased in number as the need arises and interconnected into an array to provide ready access for items such as slides and cassettes in an orderly storage system.

2. Background of the Prior Art

The following United States patents disclose storage cabinets and devices for a variety of different objects such as printed circuit boards, electronic instruments, product packaging parts, etc.

Kent et al—U.S. Pat. No. 3,288,301
Barney—U.S. Pat. No. 3,729,242
Black, Jr., et al—U.S. Pat. No. 3,751,127
Wirbilowicz et al—U.S. Pat. No. 3,964,809
Butler—U.S. Pat. No. 4,123,129
Bishoff et al—U.S. Pat. No. 4,192,562
Correia—U.S. Pat. No. 4,232,916
Fortune—U.S. Pat. No. 4,401,350

OBJECTS OF THE PRESENT INVENTION

It is an object of the present invention to provide a new and improved expandable modular storage system and more particularly a new and improved modular storage system for holding slides and cassettes of the type used for various research and/or medical applications.

It is another object of the present invention to provide a new and improved expandable modular storage system of the character described having modular compartments formed by at least two cooperable wall elements which are detachably interlockable to form a four-sided compartment.

Another object of the present invention is to provide a new and improved expandable modular storage system of the character described wherein the wall elements are formed of extruded aluminum or plastic material and are slidably interlockable together to provide storage compartments as needed.

Yet another object of the present invention is to provide a new and improved modular storage system of the character described including modular storage compartments which are detachably interconnectable to add or subtract individual compartments as needed forming an array of compartments in rows and/or columns.

Yet another object of the present invention is to provide a new and improved expandable modular storage compartment of the character described having wall elements supporting a detachable divider wall for dividing the compartment into a plurality of subcompartments when needed.

Another object of the present invention is to provide a new and improved modular storage system of the character described providing storage compartments and/or sub-compartments for receiving slidable drawers adapted to contain objects such as slides and/or cassettes.

Yet another object of the present invention is to provide a new and improved expandable modular storage system of the character described wherein a detachable end wall may be provided when desired and the end wall is easily secured to the wall elements of an individual storage compartment or an array of compartments in a storage system.

Yet another object of the present invention is to provide a new and improved expandable modular storage system which is relatively low in cost, easily expandable to accommodate additional materials and modular in nature to provide storage capability for objects of various different sizes in various different arrays as desired.

BRIEF SUMMARY OF THE INVENTION

The foregoing and other objects and advantages of the present invention are accomplished in a new and improved expandable modular storage system comprising a plurality of modular storage compartments formed by interconnecting first and second wall elements which are detachably interlockable to provide a four-sided enclosure. The first wall element includes a first wall with a pair of parallel facing opposite second walls integrally joined along opposite edge portions and normal thereto. Free outer edge portions of the second walls are slidably attached to a second wall element along opposite edges thereof to complete a four-sided storage enclosure. Additional compartments may be provided by interconnecting first and/or second wall elements and interlocking the same with an existing storage compartment or array of compartments to provide additional storage capability as needed. In addition, storage compartments in stacked rows may be secured together by joining elements to provide expansion of a storage array in both vertical and horizontal directions as desired.

Drawer elements for containing slides and/or cassettes are provided for use in the compartments or sub-compartments, which sub-compartments may be formed by a divider wall detachably interconnected with wall elements of a single compartment.

Preferably, the first and second wall elements are formed of elongated strips of extruded aluminum or plastic material which are cut to appropriate lengths as needed. The extruded material is light in weight, relatively low in cost and is resistant to corrosion and deterioration in order to provide a storage system having a long and useful life. Individual storage compartments may be added as desired or disassembled and replaced or repositioned and when required, an end wall may be readily secured to selected ones or all of the storage compartments present in a modular system.

BRIEF DESCRIPTION OF THE DRAWING

For better understanding of the invention, reference should be had to the following detailed description, taken in conjunction with the drawings in which:

FIG. 1 is a front elevational, perspective view of a new and improved expandable modular storage system constructed in accordance with the features of the present invention with portions shown in phantom;

FIG. 1*a* is a fragmentary, exploded perspective elevational view of a back side of the modular storage system of FIG. 1 illustrating in a graphic fashion means for securing a back or end wall to a compartment;

FIG. 2 is a fragmentary enlarged front elevational view of a plurality of modular storage compartments shown in disassembled condition ready for assembly;

FIG. 2*a* is a fragmentary, exploded, perspective, front or back elevational view of a corner portion of a pair of interconnected modular storage compartments;

FIG. 3 is an enlarged, front elevational, perspective view of another embodiment of an expandable modular storage system constructed in accordance with the features of the present invention;

FIG. 4 is an enlarged, front elevational, exploded perspective view of a drawer and slide rack in accordance with the invention;

FIG. 4*a* is a transverse cross-sectional view taken substantially along lines 4*a*—4*a* of FIG. 4;

FIG. 5 is an enlarged, front elevational, exploded perspective view of another embodiment of a drawer for holding medical samples in accordance with the invention; and FIG. 6 is an enlarged, front elevational, exploded perspective view of the drawer of FIG. 5 and a removable holder for containing groups of photographic slides.

DESCRIPTION OF A PREFERRED EMBODIMENT

Referring now more particularly to the drawings, in FIG. 1 is illustrated an expandable modular storage system 10 constructed in accordance with the features of the present invention. The modular storage system includes a plurality of individual storage compartments 12 arranged and interconnected in an expandable array of horizontal rows and vertical columns. As will be described in more detail, individual adjacent storage compartments 12 in a row are interlocked together. Adjacent stacked vertical rows of compartments are interlocked together at opposite ends of the rows by elongated joining elements 14. It should also be noted that enlarged open spaces 16 and 18 of different sizes may be formed in the array of the storage system 10 in order to build around obstructions or to provide access to provide access to wall-mounted switches, etc.

Each storage compartment 12 is formed by one or two, first wall elements 20 of generally C-shaped transverse cross-section slidably interconnected together and the storage compartment 12 at one end of a row includes a first C-shaped wall element 20 and an interlocking second wall element 22 which is not of C-shaped cross-section and which is designed for closing off and forming a last compartment in a row.

Each first wall element 20 includes a first side wall 24 and a pair of parallel, upper and lower second walls 26 and 28 extending outwardly perpendicular thereto from upper and lower edge portions. The walls 24, 26 and 28 of each C-shaped first wall element 20 are preferably integrally formed together in a unitary extrusion process. Preferably, the wall elements are formed of aluminum but also may be made of extruded plastic material.

In the lefthand compartment 12 shown in FIG. 2, the vertical sides of the compartment are formed by the first walls 24 of a pair of adjacent C-shaped extrusions 20, and the upper and lower walls 26 and 28, respectively, comprise integral walls of the lefthand C-shaped extrusion alone. Each C-shaped extrusion element 20 is provided with a pair of elongated, outwardly open grooves 30 for accommodating flanges 14*a* of joining elements 14 and/or edge flanges 26*a* and 28*a*, respectively, of another C-shaped element. These edge flanges are formed at right angles along outer edges of the upper and lower second walls 26 and 28 of each C-shaped extrusion. The inwardly extending edge flanges 26*a* and 28*a* of the C-shaped extrusions 20 are dimensioned to slide freely within the grooves 30 which open outwardly and extend longitudinally along and adjacent to the upper and lower corner portions of the sidewall 24. Any number of extrusions 20 and thus any number of compartments 12 can be formed and interconnected together in a single horizontal row of indeterminate length as desired.

At the end of a row, a last storage compartment 12 is formed by a combination of a C-shaped extrusion 20 and a second wall element 22 of generally flat transverse cross-section as shown in FIG. 2. The flat wall elements 22 are formed with a pair of outwardly opening longitudinal grooves 32 on opposite sides thereof adjacent both the upper and lower edges. The grooves 32 of the second wall element 22 are dimensioned to be similar in size to the grooves 30 in the C-shaped elements in order to slideably receive the inwardly projecting edge flanges 26*a* and 28*a* of a C-shaped extrusion element or the flange 14*a* of a joining element 14.

As illustrated in FIG. 2, the outwardly facing grooves 32 on the second wall element 22 are also adapted to accommodate the edge flanges 14*a* of elongated joining elements 14 when additional rows of storage compartments are stacked in a vertical array as shown. Upper and lower ends of the respective outwardly facing slots 30 on the C-shaped first wall elements 20 are at least partially closed by elongated ribs 26*b* and 28*b*, respectively, extending parallel and offset outwardly from the outer surfaces of the respective walls 26 and 28. Similar ribs 26*c* and 28*c* are provided on the outer surface of the second walls 26 and 28 along the free outer edge thereof opposite the respective inwardly projecting edge flanges 26*a* and 28*a*. Similarly ribs 22*a* are formed along opposite longitudinal edges of the secondary wall elements 22 at the upper and lower ends of the slots 32 on opposite sides. When several rows of assembled compartments 12 are stacked vertically upon one another to form an array, the ribs 22*a*, 26*b*, 26*c*, 28*b* and 28*c* provide supporting feet between adjacent pairs of vertically spaced compartments 12.

At the ends of a row, the adjacent ribs 28*b* and 26*b* of each pair of adjacent, upper and lower compartments 12 are sandwiched together and secured within a central channel shaped body portion 14*b* of a joining strip 14. At the opposite end of the row, the adjacent ribs 22*a* of upper and lower secondary wall elements 22 are similarly sandwiched together and held in position within the channel shaped body 14*b* of an opposite joining strip 14. This arrangement positively interlocks and secures each successive row of compartments upon a lower row directly therebeneath.

In accordance with the present invention, the side walls 24 are provided with opposite pairs of spaced apart, outwardly extending ribs 24*a* formed on opposite faces at a mid-level. Each pair of ribs provides an outwardly opening groove 34 for slidably receiving a longitudinal edge portion of a removable divider wall 36 which may be slipped into place when desired to divide each compartment 12 into a pair of smaller, upper and lower sub-compartments 12*a* and 12*b*. The secondary wall elements 22 are likewise provided with opposite pairs of spaced apart, longitudinally extending ribs 22*b* on opposite faces to provide a pair of outwardly facing, open grooves 38 adapted to receive an edge portion of a divider wall 36.

Any number of modular compartments 12 may be assembled together in a single row by simply interconnecting together an appropriate number of C-shaped, primary wall elements 20. This is done by engaging the ribs 26*a* and 28*a* of one element within the respective upper and lower grooves 30 on the vertical wall 24 of the next adjacent element and sliding the two elements together until the ends of the elements are in alignment.

Referring to FIG. 2*a*, after the modular compartments 12 have been formed, the adjacent slidably engaged, C-shaped elements 20 and wall elements 22 may be fixedly interlocked together to prevent any further relative movement between adjacent elements. Interlocking is accomplished by means of self-tapping set screws 21 inserted into the respective grooves 30 and 32 (FIG. 2) to threadedly engage the surrounding wall surfaces and the edge of the ribs 26*a* and 28*a*. The set screws may be of the socket type as illustrated and may be inserted from both front and back to provide more positive interlocking if desired. The set screws 21 are driven into the grooves 30 and 32 until the outer head surface of the set screws is flush with or slightly inward of the adjacent edges of the interlocked elements.

In accordance with the present invention, the C-shaped, primary wall elements 20 are formed with elongated, hollow screw splines 40 (FIGS. 2 & 1*a*) adjacent opposite edge portions of the side wall 24, and these grooves or screw splines are adapted to receive threaded shanks 42*a* of self-tapping sheet metal screws 42 which are utilized for securing a back wall or panel 44 in place on an individual compartment 12 or an array of compartments 12 of a large modular storage system 10. The screw shanks 42*a* of the self-tapping fasteners 42 pass through appropriately located holes 44*a* provided in the end wall 44 and in many instances is not a necessity to provide a self-tapping screw for each of the hollow screw splines 40 of each extrusion member. The secondary wall elements 22 of the compartments 12 are similarly provided with elongated hollow screw splines or grooves 46 for receiving the shanks of the self-tapping screws 42.

Referring now to FIG. 3, a single storage compartment 12 or a multiplicity of compartments in one or more vertical columns may be adapted for mounting on a rectangular base structure 13 of appropriate size formed of molded plastic or metal material and having a top wall 13*a*, depending front and back walls 13*b* and opposite sidewalls 13*c* integrally joined therewith. Short lengths of joining elements 14 may be utilized for securing the compartment(s) 12 on the base 13 and suitable threaded fasteners 15 are provided to positively secure the lower edge flange 14*a* of the short joining elements to the adjacent sidewalls 13*c* of the base structure.

The back end of the assembled modular compartment 12 shown in FIG. 3 is closed with a modified end panel 45, preferably formed of molded plastic material with integral corner pins 47 projecting outwardly thereof and positioned to fit into the screw splines 40 and 46 of the assembled compartment components. The modified back panel 45 is simply installed in place by centering the outer ends of the integral corner pins 47 in the respective screw splines of the compartment members and pushing the back side of the panel toward the rear edge of the members until the inside face 45*a* is closely adjacent the rear edge of the extruded aluminum, compartment forming members. Once in place as described, the integral corner pins 47 retain the back panel 45 securely in place. The panels can be removed when desired by pulling the exposed edges outwardly until the pointed ends of the integral pins 47 are out of engagement with the screw splines of the compartment members.

The modified end or back panels 45 may be rapidly put in place or withdrawn without requiring any separate fasteners and the panels may be dimensioned to cover the end of only one compartment 12 or may be larger in size, with additional pins 47 in order to cover several compartments if desired.

In accordance with the present invention, each compartment 12 and/or sub-compartment 12*a* or 12*b* may be provided with an open top drawer 50 (FIG. 4) or drawer 150 (FIG. 5), respectively, which drawers include a body formed of an elongated, extruded or molded plastic or metal drawer section 53 (FIG. 4*a*) or 153 (FIG. 5) that is cut to the appropriate length and provided with a welded or cemented in place drawer front 51 or 151, respectively. The drawers 50 and 150 are dimensioned to slide easily within the respective compartments and sub-compartments of the expandable modular storage system 10 and are open at the top ready to receive and hold a variety of different items.

Referring specifically to FIGS. 4 & 4*a*, the drawer 50 also includes a back 55 secured to the rear end of the extruded drawer section extrusion 53. The backs are preferably formed of molded plastic material with upper corner slots 55*a* provided to facilitate insertion of the drawers into the compartments. The drawer section extrusion is formed with a central divider 53*a* for dividing the drawer along a longitudinal center to provide a pair of elongated storage spaces 67 on opposite sides of the integral divider.

The drawer front 51 and back 55 are dimensioned appropriately to substantially fill or close off the end of a full compartment 12. The relatively tall drawer front extends above the upper edges of the drawer section 53 and is preferably formed in a unitary piece of molded plastic material. The drawer front may also be formed by cutting off an appropriate length of a continuous extrusion and cementing or adhesively securing the cut-off length to the forward end of the drawer section extrusion 53. The drawer section may also be formed by cutting off an appropriate length of a continuous extrusion or alternately comprises an individually molded section of the proper length.

The drawer front is integrally formed with an outwardly projecting handle portion 57 of generally T-shaped cross-section which provides a convenient pull for the drawers 50 at a mid-level on the drawer front 51. An outer face of the handle portion 57 is provided with a small channel-shaped recess 57*a* in order to receive and hold an information or identification tag or decal 59 which is slipped into place from an edge of the handle portion. The handle portion 57 thus serves the dual function of a drawer pull and a receptacle for holding a name tag or identification slip.

The elongated storage sections 67 formed on opposite sides of the divider 53*a* of the drawer section 53 provide support for a plurality of upstanding slides or samples 58 having identification means 60 adjacent the upper end portion as shown in FIG. 4*a*. Individual slides in each row of the drawer 50 may be spaced and separated from one another while supported in an upstanding position for easy viewing of the identifying information 60 by means of a wire support rack 70 which is inserted into the drawer between the drawer front 51 and back 55.

The support rack 70 includes a plurality of W-shaped slide separators 72 which are spaced apart and joined to a plurality of elongated, parallel, support rods 74 adapted to rest upon the upper edges of the side walls and divider 53*a* of the drawer section 53 when the rack is in place as shown in FIG. 4*a*. Transverse stiffening rods 76 are provided at the forward end, rearward end and mid-area of the support rack structure. The wire elements 72, 74 and 76 are joined together by welding or adhesive material and may be formed of metal or plastic material. The support rack 70 may be easily inserted into a drawer 50 and may be readily removed when required. The rack provides separation between individual slides 58 which facilitates the withdrawal and replacement of individual slides in a drawer and facilitates viewing of the identification information 60 on each slide.

Referring now to FIG. 5, therein is illustrated a drawer 150 adapted to fit into a subcompartment 12*a* or 12*b* so that two such drawers may be contained within the space of a single full compartment 12 of the modular storage system 10. The drawer 150 is similar to the drawer 50 except that the drawer front 151 and back 155 are shorter than the front 51 and back 55 of the taller drawer 50 previously described. An integral pull handle 157 and a shallow recess 157*a* for an identification tag 159 are provided on the drawer front 150, and the extruded drawer body section 153 is similar to the section 53 previously described so as to provide a pair of elongated storage spaces 167 on opposite sides of the integral divider wall 153*a*.

Each storage space 167 in the drawer 150 is adopted to store and hold a plurality of medical tissue sample cassettes 180 and/or sample embedding rings 182 arranged in a row. The drawers are dimensioned so that the cassettes will fit between the upstanding side walls and divider 153*a* of the drawer section extrusion 153.

The cassette 180 comprise a molded plastic frame of rectangular shape having an open central portion which is filled with a wax body 183 in which the medical tissue sample or other item is embedded. A forward face portion 185 of the plastic frame of the cassette is sloped at an angle to facilitate viewing of information contained thereon in the form of a label, decal or direct writing. Front and back sides of the cassettes 180 are shown in FIG. 5 and these cassettes are readily inserted and easily removed from the drawer spaces 167 as desired.

The sample embedding rings 182 are somewhat thicker than the cassettes 180 and include a flat rectangular flange or frame 187 having a central opening surrounded by a peripheral flange 189 for containing a relatively thick wax body 191 in which a specimen or sample is embedded. Identification information, labels or decals can be provided on the upper portion of the flange or frame 187 as desired and because of the relative thickness of the sample body 191, the information is readily viewable when the cassettes are in place in a row in the drawer spaces 167.

Referring now to FIG. 6, therein is illustrated a drawer 150A which is similar to the drawer 150 of FIG. 5 except that a body section 153A of the drawer does not have a central divider. The drawer 150A is adapted to receive a removable slide holder or tray 190 formed of thin-walled molded plastic material adapted to hold 35 mm. photographic slides 192 in groups or bunches of appropriate number.

The tray or holder 190 includes an upper peripheral flange 193 of rectangular shape adapted to be set on the upper edges of the side walls of the drawer body section 153A and the holder includes integral opposite sidewalls 194 and front and back walls 195 joined to an integral bottom wall. The sidewalls 194 and bottom wall are formed with inwardly extending integral ribs 194*a* at appropriate longitudinally spaced intervals along the length of the drawer in order to provide a space or separation between groups or bunches of the slides contained in the tray to facilitate pick up and removal of the slides 192 in a group by group fashion. The ribs 194*a* have a rounded crosssectional profile to facilitate and guide insertion of the slide groups into the spaces between adjacent ribs.

With the increasing number of medical tests and the need for maintaining records and tissue samples relating to the tests in slides or tissue sample cassettes over long periods of time, the expandable modular storage system 10 in accordance with the present invention fills a long felt need. The system provides convenient, expandable and reducible storage capacity for both cassettes and/or slides at a minimum cost ready for easy retrieval of an individual slide or cassette. The modular storage system can be increased or decreased in size and storage capacity as needed and individual compartments 12 can be added or removed, or even rearranged in an array from time to time in order to fit a particular wall or surface area that is available. The modular system 10 provides a universal, system for long term, permanent storage capacity at an economical cost and is particularly adaptable to conform in shape to available wall spaces.

Although the present invention has been described with reference to several illustrated embodiments thereof, it should be understood that numerous other modifications and embodiments can be made by those skilled in the art that will fall within the spirit and scope of the principles of this invention.

What is claimed as new and is desired to be secured by Letters Patent is:

1. An expandable, modular storage system, comprising:

at least one storage compartment formed by a first wall element having a first wall with a pair of parallel, facing, opposite second walls integrally joined along opposite edge portions of said first wall extending normal thereto and having free outer edge portions; and a second wall element having opposite edge portions detachably interlockable with said free outer edge portions of said second walls to complete four sides of said storage compartment, said free outer edge portions of said first wall element and said opposite edge portions of said second wall element including at least one pair of cooperating tongue and groove elements on said respective first and second wall for providing said detachable interlockable engagement between edge portions thereof.

2. The modular storage system of claim 1 wherein said second wall element comprises a first wall of another of said first elements detachably interlocked with said free outer edge portions.

3. The modular storage system of claim 1 wherein said first and second wall elements include support means for carrying a divider wall for dividing said storage compartment into a plurality of sub-compartments.

4. The modular storage system of claim 1 including at least one additional of said storage compartments interconnected with said one compartment and at least one joining element for detachably interconnecting said walls of said wall elements of a plurality of said storage compartments.

5. The modular storage system of claim 4 including at least another of said joining elements for detachably interconnecting wall elements of at least one pair of said storage compartments.

6. The modular storage system of claim 1 wherein said tongue and groove elements extend longitudinally along said respective edge portions of said respective first and second wall elements for providing continuous slidable engagement therebetween for preventing separation thereof in a direction normal to said longitudinal edge portions.

7. The modular storage system of claim 1 wherein one of said first and second wall elements includes a plurality of groove elements for receiving respective tongue elements of another of said first and second wall elements and a joining element for interconnecting another of said storage compartments therewith.

8. The modular storage system of claim 1 including a drawer for containing a plurality of sample elements mounted for reciprocal sliding movement into and out of said storage compartment supported by at least one of said wall elements.

9. The modular storage system of claim 3 including a plurality of drawers for containing a plurality of sample element mounted for reciprocal sliding movement into and out of said sub-compartments.

10. The modular storage system of claim 9 wherein one of said drawers is supported for said sliding movement on said divider wall.

11. The modular storage system of claim 1 wherein said second wall element includes connector means along said opposite edge portions for interconnection with said free outer edge portion of said first wall element and a plurality of joining elements for detachably interconnecting a plurality of said storage compartments with said one storage compartment adjacent opposite sides.

12. The modular storage system of claim 11 said connector means comprises pairs of tongue and groove connector means along said opposite edge portions of said second wall element.

13. The modular storage system of claim 12 wherein each pair of said tongue and groove connector means includes a pair of outwardly opening grooves on said second wall elements along each of said opposite edge portions thereof.

14. The modular storage system of claim 1 wherein said storage compartment includes end wall means secured to said first and second wall elements for closing one end of said compartment.

15. The modular storage system of claim 14 wherein at least one of said first and second wall elements includes a hollow spline for receiving a fastener for securing said end wall means in place.

16. The modular storage system of claim 15 wherein said first wall element includes a plurality of said hollow splines adjacent said opposite edge portions of said first wall tnereof.

17. The modular storage system of claim 15 wherein said second wall element includes a plurality of said hollow splines adjacent said opposite edge portions thereof.

18. The modular storage system of claim 15 wherein each of said storage compartments includes at least one of said hollow splines adjacent each corner thereof formed by said four sides.

19. The modular storage system of claim 8 wherein said drawer includes a divider wall forming a plurality of drawer compartments therein.

20. The modular storage system of claim 1, including:

fastener means insertable into said groove element of said cooperating tongue and groove elements for fixedly securing said first and second wall elements together against movement out of interlocking relationship.

21. The modular storage system of claim 1, including:

fastener means for fixedly securing said first and second wall elements against movement out of interlocking relationship.

22. The modular storage systems of claim 20, wherein:

said fastener means includes a self tapping set screw threadedly engaging said tongue and groove elements.

23. The modular storage system of claim 22, wherein:

said set screw is contained within said groove element.

24. The modular storage system of claim 8, wherein:

said drawer comprises a body section of extruded material having a bottom and upstanding opposite sides; and a pair of front and back walls secured to front and back ends of said body section.

25. The modular storage system of claim 8, wherein:

said drawer comprises a body section of extruded material having a bottom and upstanding opposite sides; and a pair of front and back walls secured to front and back ends of said body section.

26. The modular storage system of claim 25, wherein:

said front wall comprises a unitary molded element having an outwardly projecting, integral drawer pull.

27. The modular storage system of claim 26, wherein:

said drawer pull includes a shallow recess in an outer face for holding identification means.

28. The modular storage system of claim 27 wherein:

said drawer pull has a T-shaped transverse cross-section extending outwardly of another face of said front wall.

29. The modular storage system of claim 25, wherein:

said body section includes an upstanding divider between said opposite sides forming storage spaces on opposite sides of said divider for said sample elements.

30. The modular storage system of claim 25, including:

support means removably mounted in said body section between said front and back walls for supporting said sample elements in upstanding spaced apart relation in said drawer.

31. The modular storage system of claim 25, including:

support means removably mounted in said drawer between said front and back wall for supporting elements arranged in groups with space between said groups to facilitate withdrawal and replacement of said elements in said drawer on a group by group basis.

32. The modular storage system of claim 19, wherein:

said divider wall is detachable from said remaining portion of said drawer providing a unitary storage space therein.

* * * * *